US008249488B2

(12) United States Patent
Gilmartin et al.

(10) Patent No.: US 8,249,488 B2
(45) Date of Patent: Aug. 21, 2012

(54) BIAS CHARGE ROLLER COMPRISING OVERCOAT LAYER

(75) Inventors: Brian P. Gilmartin, Williamsville, NY (US); Liang-Bih Lin, Rochester, NY (US); Jeanne M. Koval, Marion, NY (US); Aaron M. Stuckey, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 199 days.

(21) Appl. No.: 12/707,026

(22) Filed: Feb. 17, 2010

(65) Prior Publication Data

US 2011/0200362 A1 Aug. 18, 2011

(51) Int. Cl.
*G03G 15/02* (2006.01)

(52) U.S. Cl. ..... 399/176

(58) Field of Classification Search ..... 399/168, 399/174, 176, 313; 430/902; 347/140
See application file for complete search history.

(56) References Cited

U.S. PATENT DOCUMENTS

| | | | | |
|---|---|---|---|---|
| 3,684,364 | A | 8/1972 | Schmidlin | |
| 5,248,553 | A * | 9/1993 | Miyashita et al. | 428/297.1 |
| 5,613,173 | A | 3/1997 | Kunzmann et al. | |
| 6,141,516 | A * | 10/2000 | Law et al. | 399/176 |
| 6,807,389 | B2 | 10/2004 | Facci et al. | |
| 6,842,594 | B2 | 1/2005 | Frankel | |
| 6,993,270 | B2 * | 1/2006 | Yoshioka et al. | 399/313 X |
| 7,177,572 | B2 | 2/2007 | DiRubio et al. | |
| 7,340,200 | B2 * | 3/2008 | Kosuge | 399/176 |
| 7,623,812 | B2 | 11/2009 | Kagawa | |
| 2007/0003315 | A1 * | 1/2007 | Iwai | 399/100 |
| 2008/0032219 | A1 | 2/2008 | Lin et al. | |

* cited by examiner

*Primary Examiner* — Sandra Brase
(74) *Attorney, Agent, or Firm* — Fay Sharpe LLP

(57) ABSTRACT

Disclosed are bias charge rollers having an overcoat layer. The overcoat layer comprises an acrylonitrile-butadiene-styrene (ABS) terpolymer and metal oxide particles optionally doped with a doping agent. The resulting bias charge rollers have reduced streaking and increased service lifetimes.

20 Claims, 9 Drawing Sheets

BIAS CHARGE ROLLER COMPRISING OVERCOAT LAYER

BACKGROUND

The present disclosure relates to overcoat layers useful in bias charge rollers, imaging apparatuses, and the rollers and apparatuses themselves. Among other advantages, the overcoat layers improve the lifetimes of the rollers and apparatuses while limiting streaking.

Electrostatographic and xerographic reproductions may be initiated by depositing a uniform charge on an imaging member, i.e. photoreceptor, followed by exposing the imaging member to a light image of an original document. Exposing the charged imaging member to a light image causes discharge in areas corresponding to non-image areas of the original document while the charge is maintained on image areas, creating an electrostatic latent image of the original document on the imaging member. The latent image is subsequently developed into a visible image by depositing a charged developing material, i.e. toner, onto the photoconductive surface layer, such that the developing material is attracted to the charged image areas on the imaging member. Thereafter, the developing material is transferred from the imaging member to a copy sheet or some other image support substrate to which the image may be permanently affixed for producing a reproduction of the original document. In a final step in the process, the imaging member is cleaned to remove any residual developing material therefrom, in preparation for subsequent imaging cycles.

Various devices and apparatuses have been used to create a uniform electrostatic charge or charge potential on the photoconductive surface of an imaging member before forming the latent image thereon. Charging of the imaging member may be broken down into two types: noncontact and contact charging. Traditionally, noncontact charging has been used. In this method, corona generating devices are utilized to apply a charge to the imaging member. In a typical corona generating device, a suspended electrode, or coronode, comprising a thin conductive wire is partially surrounded by a conductive shield. The device is placed in close proximity to the photoconductive surface of the imaging member. The coronade is electrically biased to a high voltage potential, causing ionization of surrounding air which results in the deposit of an electrical charge on an adjacent surface, namely the photoconductive surface of the imaging member.

Several problems have historically been associated with corona generating devices. Problems include the use of very high voltages, i.e. from 3,000 to 8,000 V, requiring the use of special insulation, inordinate maintenance of corotron wires, low charging efficiency, the need for erase lamps and lamp shields, arcing caused by non-uniformities between the coronode and the surface being charged, vibration and sagging of corona generating wires, contamination of corona wires, and, in general, inconsistent charging performance due to the effects of humidity and airborne chemical contaminants on the corona generating device.

Perhaps the most significant problem with corona generating devices is the generation of ozone and nitrogen oxides. Corona charging ionizes the air between the charging device and the imaging member and some diatomic oxygen ($O_2$) is inevitably converted to ozone ($O_3$). Ozone poses well-documented health and environmental hazards. Nitrogen oxides oxidize various machine components, adversely affecting the quality of the final output print produced.

A bias charge roller is a contact charger that has been developed and overcomes some of the deficiencies of corona generating devices. When used to charge an imaging member, a roller used to create a charge on another surface or substrate is commonly referred to as a bias charge roller. When used to charge an intermediate transfer member that transfers a developed image from an imaging member to a substrate member, this roller is sometimes called a bias transfer roll. Although both may differ in minor details particular to their applications, a bias transfer roll should also be considered a bias charge roller for purposes of this application.

Imaging apparatuses comprising bias charge rollers have a power supply for providing a voltage to the bias charge roller. The power supply may be a part of the bias charge roller or may be a separate component.

Bias charge rollers require their outer layer to have a resistivity within a desired range. Materials with resistivities which are too low will cause shorting and/or unacceptably high current flow to the imaging member. Materials with too high resistivities will require unacceptably high voltages. Other problems which can result if the resistivity is not within the required range include nonconformance at the contact nip and poor toner releasing properties. These adverse effects can also result in the bias charge roller having non-uniform resistivity across the length of the contact member. Other problems include resistivity that is susceptible to changes in temperature, relative humidity, and running time.

Bias charge rollers also cause wear and tear to imaging members because they physically contact the imaging member. One of the more common problems is the appearance of streaks along the process direction, i.e. the circumference, or white and dark spots associated with surface damage. These streaks may result in print defects that can shorten the lifetime of the bias charge roller, the imaging member, and the ink or toner cartridge. Streaking usually develops as a result of the degradation of the bias charge roller material and/or the buildup of debris along the process direction of the roller. Defects include scratches, abrasions, potholes, and the like.

It would be desirable to develop a bias charge roller that reduces streaking and has an increased service lifetime.

BRIEF DESCRIPTION

The present application discloses, in various embodiments, overcoat layers comprising an acrylonitrile-butadiene-styrene (ABS) terpolymer and metal oxide particles optionally doped with a doping agent. Bias charge rollers which comprise the overcoat layers and imaging apparatuses comprising the bias charge rollers are also disclosed. The overcoat layers reduce streaking and increase the service lifetime of the bias charge rollers.

In embodiments, a bias charge roller is disclosed which comprises a conductive core and an overcoat layer. The overcoat layer comprises an ABS terpolymer and metal oxide particles optionally doped with a doping agent.

The metal oxide may be titanium dioxide ($TiO_2$).

The doping agent may be iron. The doping agent may also be antimony.

The metal oxide particles may comprises from about 40 to about 60 wt % of the overcoat layer.

The ABS terpolymer may comprise from about 40 to about 60 wt % of the overcoat layer.

The overcoat layer may have a thickness of from 1 μm to 15 μm.

The ABS terpolymer may comprises from about 15 to about 35 wt % acrylonitrile, from about 5 to about 30 wt % butadiene, and from about 40 to about 60 wt % styrene.

The doping agent may comprise from about 15 to about 50 wt % of the total weight of the metal oxide particles.

The metal oxide particles may have a surface resistivity of from $10^5$ to $10^{14}$ Ω/sq.

In other embodiments, an apparatus for applying an electrical charge to a member to be charged is disclosed. The apparatus comprises a power supply for supplying a voltage and a bias charge roller situated in proximity to a surface of the member to be charged. The bias charge roller comprises an overcoat layer comprising an ABS terpolymer and metal oxide particles optionally doped with a doping agent.

An image forming apparatus for forming images on a recording medium is also disclosed. The image forming apparatus comprises an electrophotographic imaging member having a charge-retentive surface to receive an electrostatic latent image thereon, a development component to apply a developer material to the charge-retentive surface to develop the electrostatic latent image to form a developed image on the charge-retentive surface, a transfer component for transferring the developed image from the charge-retentive surface to another member or a copy substrate, a fusing member to fuse the developed image to the copy substrate, and a bias charge roller for applying a charge to the charge-retentive surface. The electrophotographic imaging member comprises a substrate, an electrically conductive layer when the substrate is not electrically conductive, a charge generating layer, and a charge transport layer. The bias charge roller comprises an overcoat layer comprised of an ABS terpolymer and metal oxide particles optionally doped with a doping agent.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
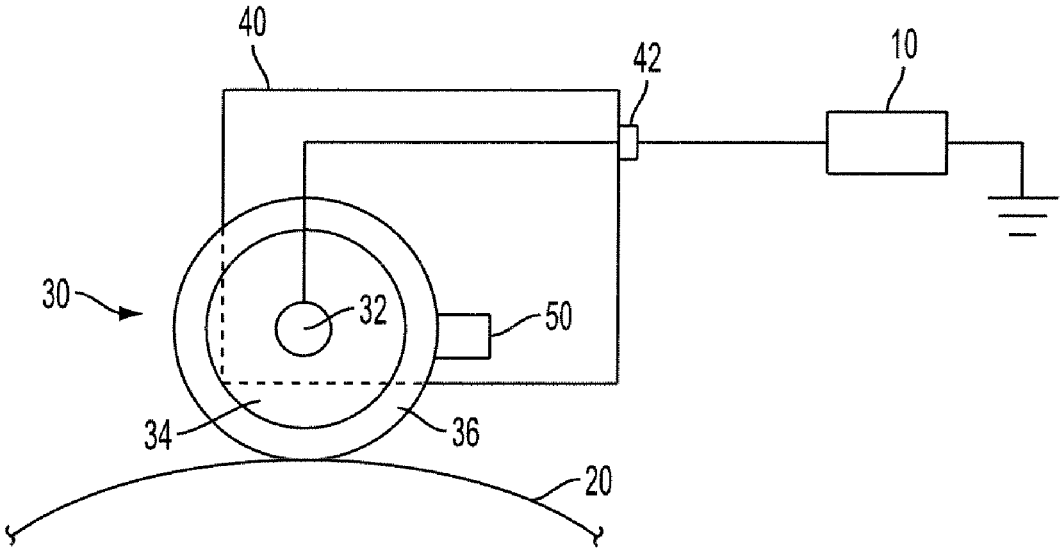
FIG. 1 illustrates an exemplary embodiment of a bias charge roller fabricated according to the present disclosure.

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range of "from about 2 to about 10" also discloses the range "from 2 to 10".

The present disclosure relates to overcoat layers that are useful in bias charge rollers of imaging apparatuses. The overcoat layers comprise an acrylonitrile-butadiene-styrene (ABS) terpolymer and metal oxide particles. The metal oxide particles can be doped with a doping agent. Bias charge rollers containing the overcoat layer are disclosed.

The present disclosure also relates to a cartridge to be placed in an imaging apparatus. The cartridge is useful for applying an electrical charge to an associated imaging member in the imaging apparatus. The cartridge comprises (1) a bias charge roller that can be situated in proximity to a surface of the imaging member and (2) a power supply for supplying a voltage to the bias charge roller. The bias charge roller comprises an overcoat layer comprised of an ABS terpolymer and metal oxide particles.

Also disclosed is an image forming apparatus for forming images on a recording medium. The image forming apparatus comprises an electrophotographic imaging member having a charge-retentive surface to receive an electrostatic latent image thereon, a development component to apply a developer material to the charge-retentive surface to develop the electrostatic latent image to form a developed image on the charge-retentive surface, a transfer component for transferring the developed image from the charge-retentive surface to another member or a copy substrate, a fusing member to fuse the developed image to the copy substrate, and a bias charge roller for applying a charge to the charge-retentive surface. The electrophotographic imaging member comprises a substrate, an electrically conductive layer when the substrate is not electrically conductive, a charge generating layer, and a charge transport layer. The bias charge roller comprises an overcoat layer comprised of an ABS terpolymer and metal oxide particles.

In FIG. 1, a portion of an image forming apparatus is shown. The image forming apparatus has a power supply 10, an imaging member surface 20, and a bias charge roller 30. One of ordinary skill in the art understands that there may be additional components in the imaging apparatus. The imaging member may be a drum, a belt, a film, a drelt, or any other type of imaging member. The bias charge roller 30 comprises a conductive core and an overcoat layer 36. As shown here, the conductive core is formed from a core 32 and a conductive layer 34.

Figure 2:
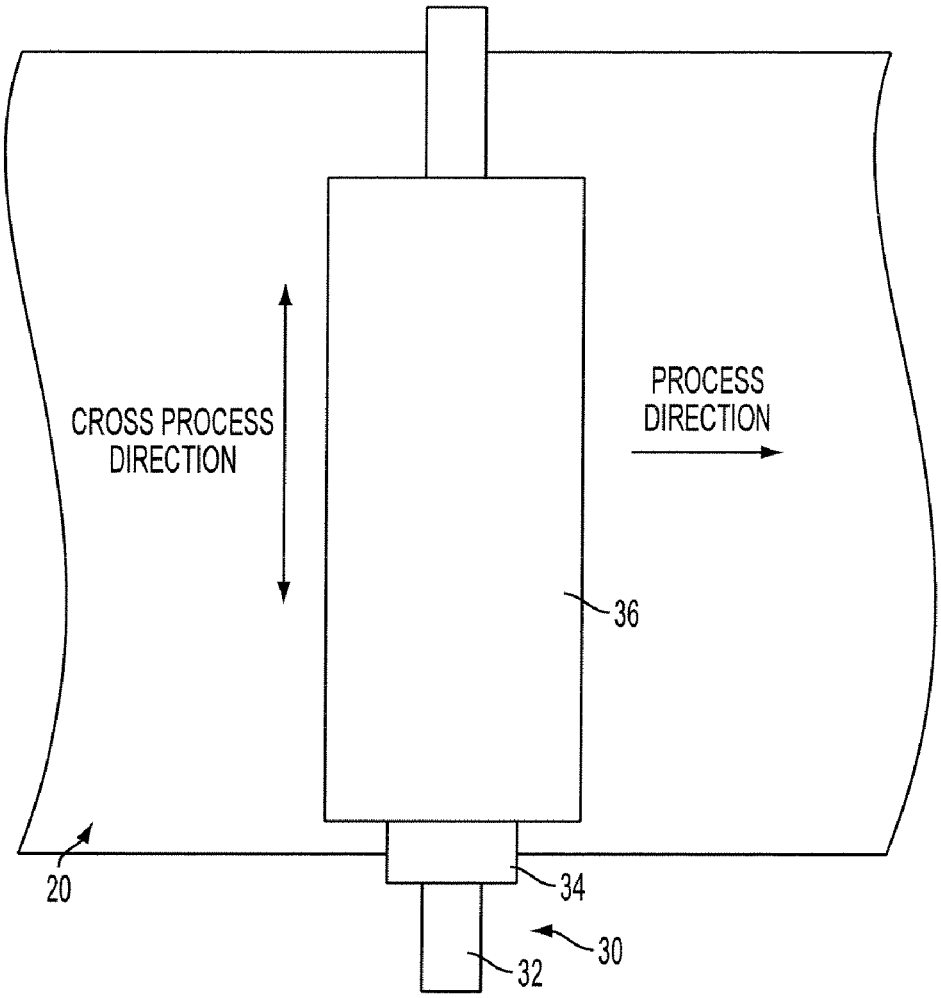
FIG. 2 is a top view of an exemplary embodiment of a bias charge roller illustrating the process direction.

FIG. 2 is a diagram illustrating the operation of the bias charge roller. The bias charge roller rotates about the axis of the core, either under its own power or by friction with the imaging member surface. The direction in which the imaging member surface travels is considered the process direction, and corresponds roughly to a radial direction of the bias charge roller itself, or perpendicular to the axis of the core.

The overcoat layer for the bias charge roller should have a surface resistivity of from $10^5$ to $10^{13}$ ohm/sq in order to achieve good print quality. The overcoat layer should adhere well to the conductive layer. As previously mentioned, the overcoat layer comprises an acrylonitrile-butadiene-styrene (ABS) terpolymer and metal oxide particles. The ABS terpolymer may comprise from about 30 to about 80 wt % or from about 40 to about 60 wt % of the overcoat layer. In particular embodiments, the ABS terpolymer comprises about 50 wt % of the overcoat layer. Acrylonitrile may comprise from about 15 to about 35 wt % of the ABS terpolymer. Butadiene may comprise from about 5 to about 30 wt % of the ABS terpolymer. Styrene may comprise from about 40 to about 60 wt % of the ABS terpolymer.

The metal oxide particles may comprise from about 20 to about 70 wt % or from about 40 to about 60 wt % of the overcoat layer. In particular embodiments, the metal oxide particles comprise about 50 wt % of the overcoat layer.

The metal oxide may generally be any conductive metal which can be oxidized. In particular embodiments, the metal may be titanium (Ti), tin (Sn), zinc (Zn), indium (In), silicon (Si), aluminum (Al), zirconium (Zr), molybdenum (Mb), nickel (Ni), cerium (Ce), lead (Pb), iron (Fe), or copper (Cu). In specific embodiments, the metal oxide is titanium dioxide ($TiO_2$) or zinc oxide (ZnO).

The metal oxide particles may be surface treated or doped with a doping agent. Use of a doping agent may alter the properties of the metal oxide particles. In particular, the surface resistivity of the metal oxide particles may be affected. The doping agent may be antimony, iron, or aluminum. Surface treatments include, but are not limited to, mixing the metal oxide with aluminum laurate, alumina, zirconia, silica, silane, methicone, dimethicone, sodium metaphosphate, and the like, and mixtures thereof. Commercially available examples of $TiO_2$ include MT-150W™ (surface treatment with sodium metaphosphate, available from Tayca Corporation), STR-60N™ (no surface treatment, available from Sakai Chemical Industry Co., Ltd.), FTL-100™ (no surface treatment, available from Ishihara Sangyo Laisha, Ltd.), STR-60™ (surface treatment with $Al_2O_3$, available from Sakai Chemical Industry Co., Ltd.), TTO-55N™ (no surface treatment, available from Ishihara Sangyo Laisha, Ltd.), TTO-55A™ (surface treatment with $Al_2O_3$, available from Ishihara Sangyo Laisha, Ltd.), MT-150AW™ (no surface treatment, available from Tayca Corporation), MT-150A™ (no surface treatment, available from Tayca Corporation), MT-100S™ (surface treatment with aluminum laurate and alumina, available from Tayca Corporation), MT-100HD™ (surface treatment with zirconia and alumina, available from Tayca Corporation), MT-100SA™ (surface treatment with silica and alumina, available from Tayca Corporation), and the like. When used, the doping agent may be present in the amount of from about 15 to about 50 wt % by weight of the particles.

The surface resistivity of the optionally doped metal oxide particles may be from about $10^5$ Ω/sq to about $10^{14}$ Ω/sq.

The metal oxide may be present in suitable amounts, such as for example, from about 5 to about 80 weight percent, and more specifically, from about 30 to about 70 weight percent, of the overcoat layer. In embodiments, the metal oxide has a diameter of from about 5 to about 300 nanometers. More specifically, the metal oxide may possess a primary particle size diameter of from about 10 to about 25 nanometers, and yet more specifically, about 15 nanometers with an aspect ratio (i.e. ratio of longest axis to shortest axis) of from about 4 to about 5.

The overcoat layer may have a thickness of from about 0.1 μm to about 500 μm, or from about 1 μm to about 50 μm. In particular embodiments, the overcoat layer has a thickness of from 1 μm to 15 μm, including about 5 μm.

The overcoat layer may be applied by any suitable conventional technique such as spraying, dip coating, draw bar coating, gravure coating, silk screening, air knife coating, reverse roll coating, vacuum deposition, chemical treatment and the like. For convenience, the overcoat layer is preferably applied in the form of a dispersion or solution, where the ABS terpolymer and metal oxide particles are dispersed or dissolved in a solvent. Suitable solvents include xylene, 1-butanol, methyl ethyl ketone, and the like and mixtures thereof. The order in which the ingredients are added to the solution/dispersion is not important. The solution/dispersion can be deposited by conventional techniques such as by vacuum, heating and the like. The solvent is removed after deposition of the solution/dispersion by conventional techniques such as by vacuum, heating and the like. The overcoat layer may be cured or dried at a temperature of from about 40 to about 200° C. for a suitable period of time, such as from about 1 minute to about 10 hours, under stationary conditions or in an air flow.

The core 32 of the bias charge roller is used to support the bias charge roller, and may generally be made up of any conductive material. Exemplary materials include aluminum, iron, copper, or stainless steel. The shape of the core may be cylindrical, tubular, or any other suitable shape. The core may have a length of from 200 mm to 700 mm. The diameter of the core may be from about 1 mm to about 20 cm, or from about 5 mm to about 2 cm.

The conductive layer 34 of the bias charge roller surrounds the core 32. The conductive layer comprises a polymeric material such as, for example, neoprene, EPDM rubber, nitrile rubber, polyurethane rubber (polyester type), polyurethane rubber (polyether type), silicone rubber, VITON/FLUOREL rubber, epichlorohydrin rubber, or other similar materials having a DC volume resistivity in the range of $10^3$ to $10^7$ ohm-cm after suitable compounding with a conductive filler such as carbon particles, graphite, pyrolytic carbon, metal oxides, ammonium perchlorates or chlorates, alkali metal perchlorates or chlorates, conductive polymers like polyaniline, polypyrrole, polythiophene, and polyacetylene, and the like. The conductive filler may be present in the amount of from about 1 to about 30 parts by weight per 100 parts by weight of the polymeric material. Desirably, the conductive layer is deformable to ensure close proximity or contact with the imaging member surface. The Shore O hardness is typically from about 15 to about 80. The elastomer may be, for example, urethane rubber, epichlorohydrin elastomers, EPDM rubbers, styrene butadiene rubbers, fluoroelastomers, silicone rubbers, or any other suitable material. The conductive layer may have any suitable thickness such as, for example, about 10 mm to about 20 cm, preferably from about 50 mm to about 3 cm. It is also possible to use a stiff, non-conformable conductive layer.

The power supply 10 may connect to the bias charge roller 30 via the core 32. The voltage provided by the power supply may be a standard line voltage or other voltage levels or signal frequencies which may be desirable in accordance with other limiting factors dependent upon the individual machine design. The power supply may provide a DC voltage, an AC voltage, or variations thereof.

In some applications, the bias charge roller may be provided in the form of a cartridge for easy insertion and removal from the image forming apparatus. As seen in FIG. 1, the cartridge 40 contains the bias charge roller 30. A power interface 42 exists to connect the bias charge roller 30 to the power supply 10 of the image forming apparatus and supply voltage to the bias charge roller. A cleaning member 50 may also be present to remove toner, paper dust, lubricant, etc. that is transferred from the imaging member surface 20 to the bias charge roller 30. The cleaning member may be, for example, a felt, sponge, etc., and may be shaped as, for example, a roller, a plate, or a sheet.

The overcoat layer of the present disclosure improves the lifetime of the bias charge roller and has improved print properties over time, i.e. it does not produce dark streaks. The overcoated bias charge roller also displays excellent charge uniformity. The overcoat layer also allows for refurbishing of a used bias charge roller; after applying the overcoat layer to the damaged surface, the bias charge roller can continue to be used.

Figure 3:
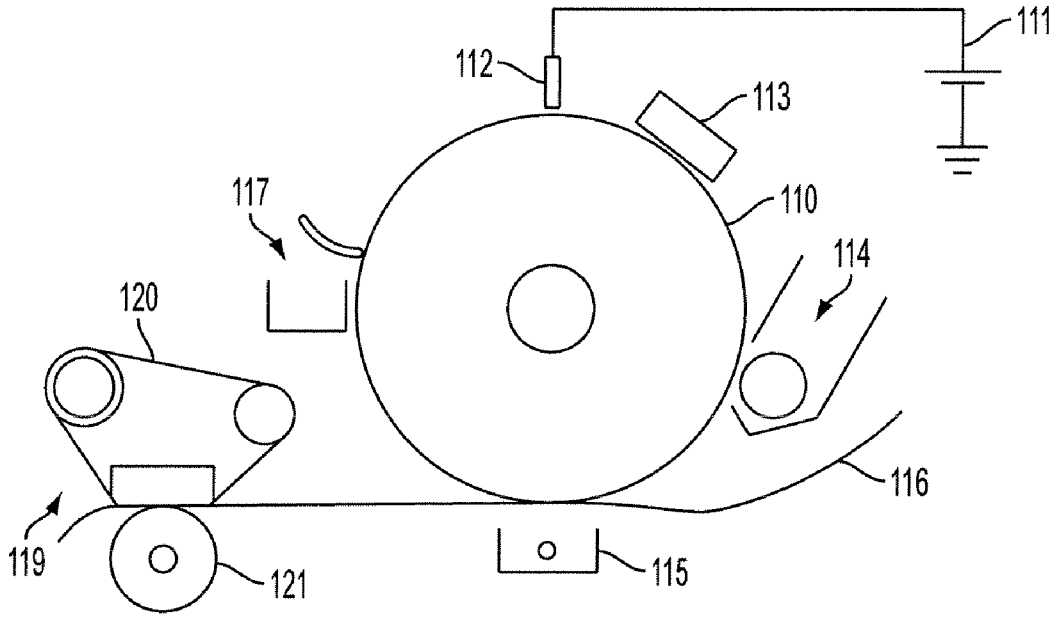
FIG. 3 illustrates an exemplary image forming apparatus of the present disclosure.

The bias charge roller may be used in an image forming apparatus that forms images on a recording medium, such as that shown in FIG. 3. Such an image forming apparatus comprises an electrophotographic imaging member, a development component, a transfer component, and a fusing member. The electrophotographic imaging member has a charge-retentive surface to receive an electrostatic latent image thereon. The electrophotographic imaging member generally comprises a substrate, an electrically conductive layer when the substrate is not electrically conductive, a charge generating layer, and a charge transport layer. Imaging members are known in the art. The bias charge roller applies a uniform charge to the charge-retentive surface. After the electrostatic latent image is generated, the development component applies a developer material, i.e. toner, to the charge-retentive surface to develop the electrostatic latent image and form a developed image on the charge-retentive surface. The transfer component transfers the developed image from the charge-retentive surface to another member or a copy substrate, such as paper. The fusing member fuses the developed image to the copy substrate.

Referring to FIG. 3, the charge-retentive surface of imaging member 110 is charged by bias charge roller 112 to which a voltage has been supplied from power supply 111. The imaging member is then imagewise exposed to light from an optical system or an image input apparatus 113, such as a laser and light emitting diode, to form an electrostatic latent image thereon. Generally, the electrostatic latent image is developed by bringing a developer mixture from developer station 114 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon. After the toner particles have been deposited on the photoconductive surface, they are transferred to a copy substrate 116 by transfer component 115, which can be pressure transfer or electrostatic transfer. Alternatively, the developed image can be transferred to an intermediate transfer member, or bias transfer member, and subsequently transferred to a copy substrate. Examples of copy substrates include paper, transparency material such as polyester, polycarbonate, or the like, cloth, wood, or any other desired material upon which the finished image will be situated. After the transfer of the developed image is completed, copy substrate 116 advances to fusing member 119, depicted as fuser belt 120 and pressure roll 121, wherein the developed image is fused to copy substrate 116 by passing the copy substrate between the fuser belt and pressure roll, thereby forming a permanent image. Alternatively, transfer and fusing can be effected by a transfix application. The imaging member 110 then advances to cleaning station 117, wherein any remaining toner is cleaned therefrom by use of a blade (as shown in FIG. 1), brush, or other cleaning apparatus.

The present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Comparative Example 1

A bias charge roller without an overcoat layer was used for comparison. The bias charge roller was tested for charge uniformity before being tested (i.e. t=0). The bias charge roller was then cycled 50,000 times in a Hodaka wear rate fixture. The bias charge roller was then tested for charge uniformity (t=50,000). The bias charge roller was also print tested in a copier after the wear testing.

Example 1

An overcoat dispersion was prepared by mixing 50 wt % Sb-doped $TiO_2$ (Passtran Type-IV 4410, commercially available from Mitsui Kinzoku Co., Ltd.) with 50 wt % ABS terpolymer (Blendex 200, commercially available from Chemtura Corp.) in tetrahydrofuran solvent. The sample was ball milled using ⅛" stainless steel shot for 18 hours. The sample was then filtered through a cotton-tip filter. A 6 μm overcoat layer was coated on a bias charge roller identical to the one used in Comparative Example 1 using a Tsukiage coater. The bias charge roller was then dried in a convection oven for 10 minutes at 120° C. The resulting overcoat layer was 50 wt % carbon black and 50 wt % ABS terpolymer.

The bias charge roller was tested for charge uniformity at t=0. The bias charge roller was then cycled 50,000 times in a Hodaka wear rate fixture, and subjected to charge uniformity testing using the same procedure used at t=0. The bias charge roller was also print tested in a copier after the wear testing.

Example 2

The procedure from Example 1 was followed except 50 wt % Fe-doped $TiO_2$ (commercially available as TTO-F-1 from Ishihara Sangyo Kaisha, Ltd.) was used instead of 50 wt % Sb-doped $TiO_2$.

Example 3

The procedure from Example 1 was followed except 50 wt % undoped $TiO_2$ (commercially available as MT-150W from Tayca Corp.) was used instead of 50 wt % Sb-doped $TiO_2$.

Charge Uniformity Testing

Figure 4:
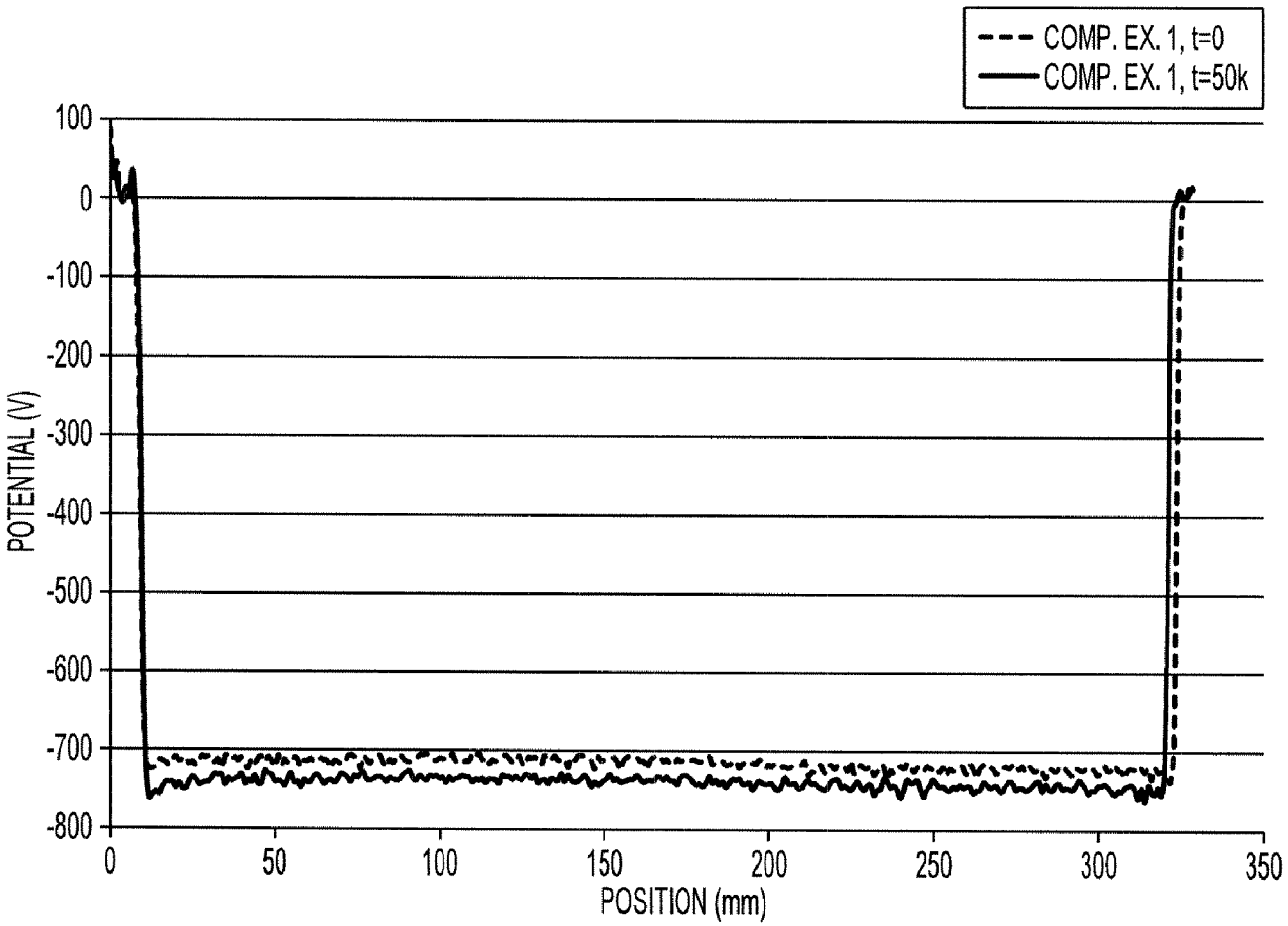
FIG. 4 is a graph showing the charge uniformity testing of a conventional bias charge roller lacking an overcoat layer.
Figure 5:
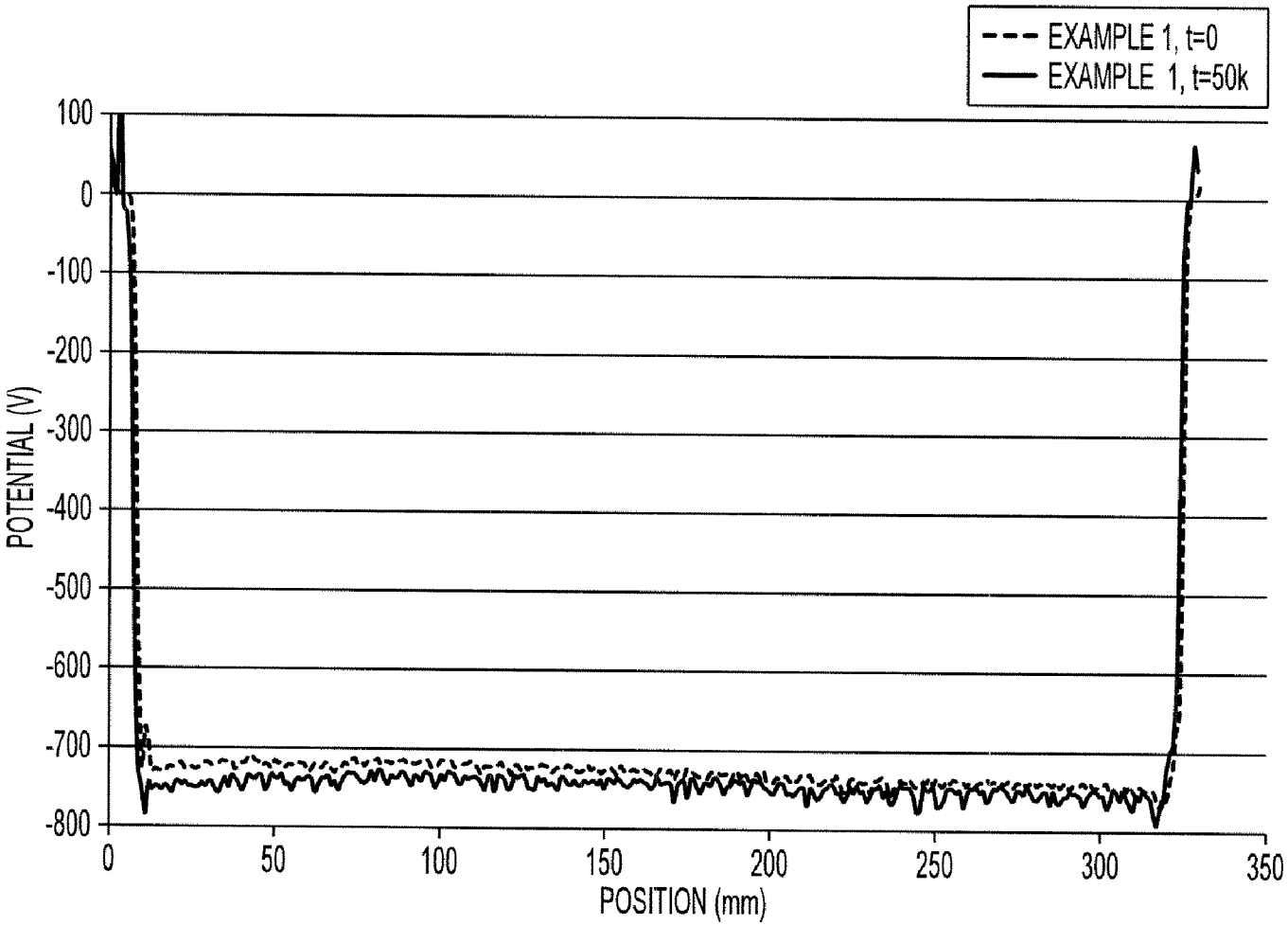
FIG. 5 is a graph showing the charge uniformity testing of a bias charge roller fabricated with an overcoat layer comprising an acrylonitrile-butadiene-styrene (ABS) terpolymer and titanium dioxide particles doped with antimony.
Figure 6:
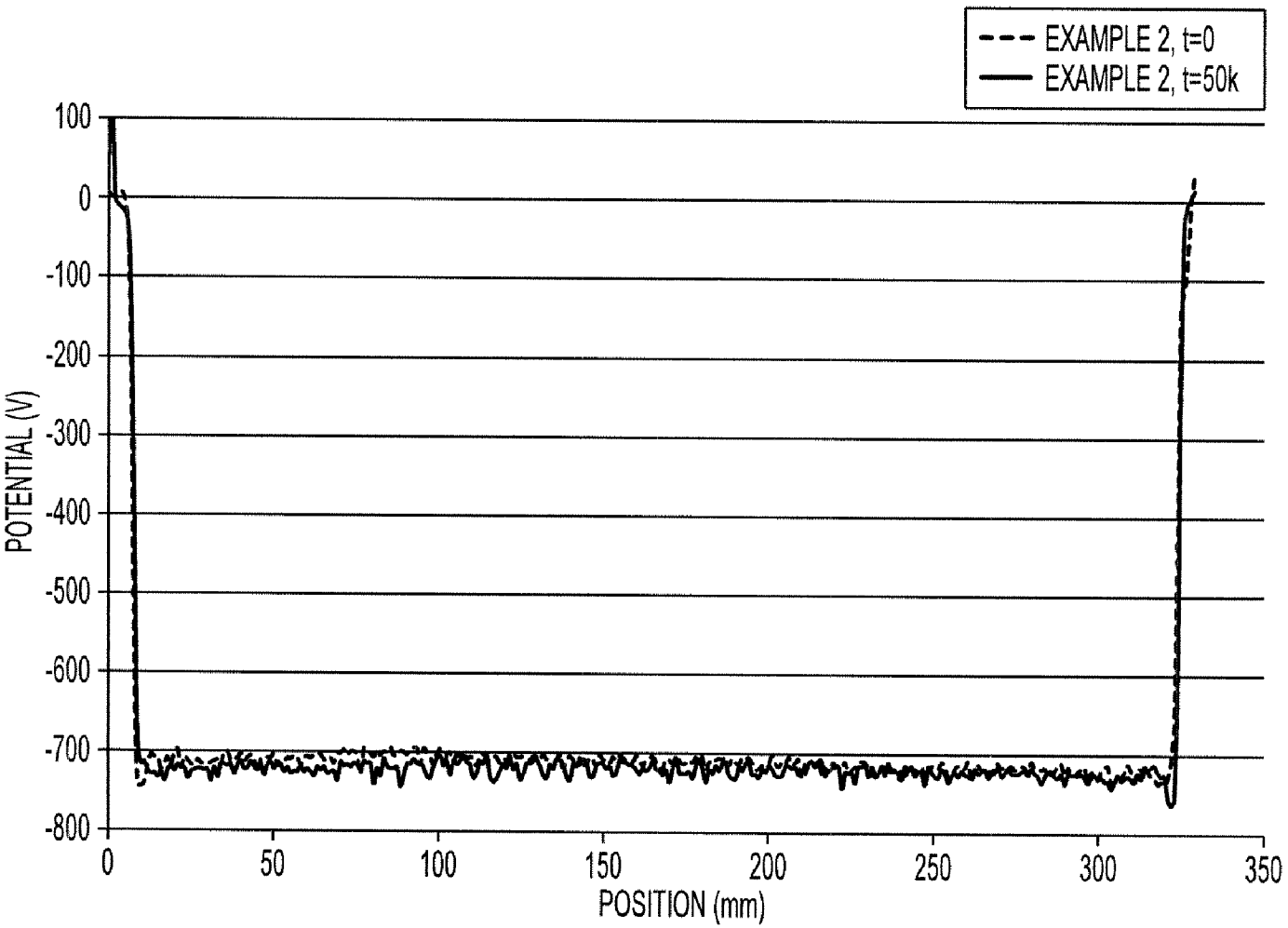
FIG. 6 is a graph showing the charge uniformity testing of a bias charge roller fabricated with an overcoat layer comprising an acrylonitrile-butadiene-styrene (ABS) terpolymer and titanium dioxide particles doped with iron.
Figure 7:
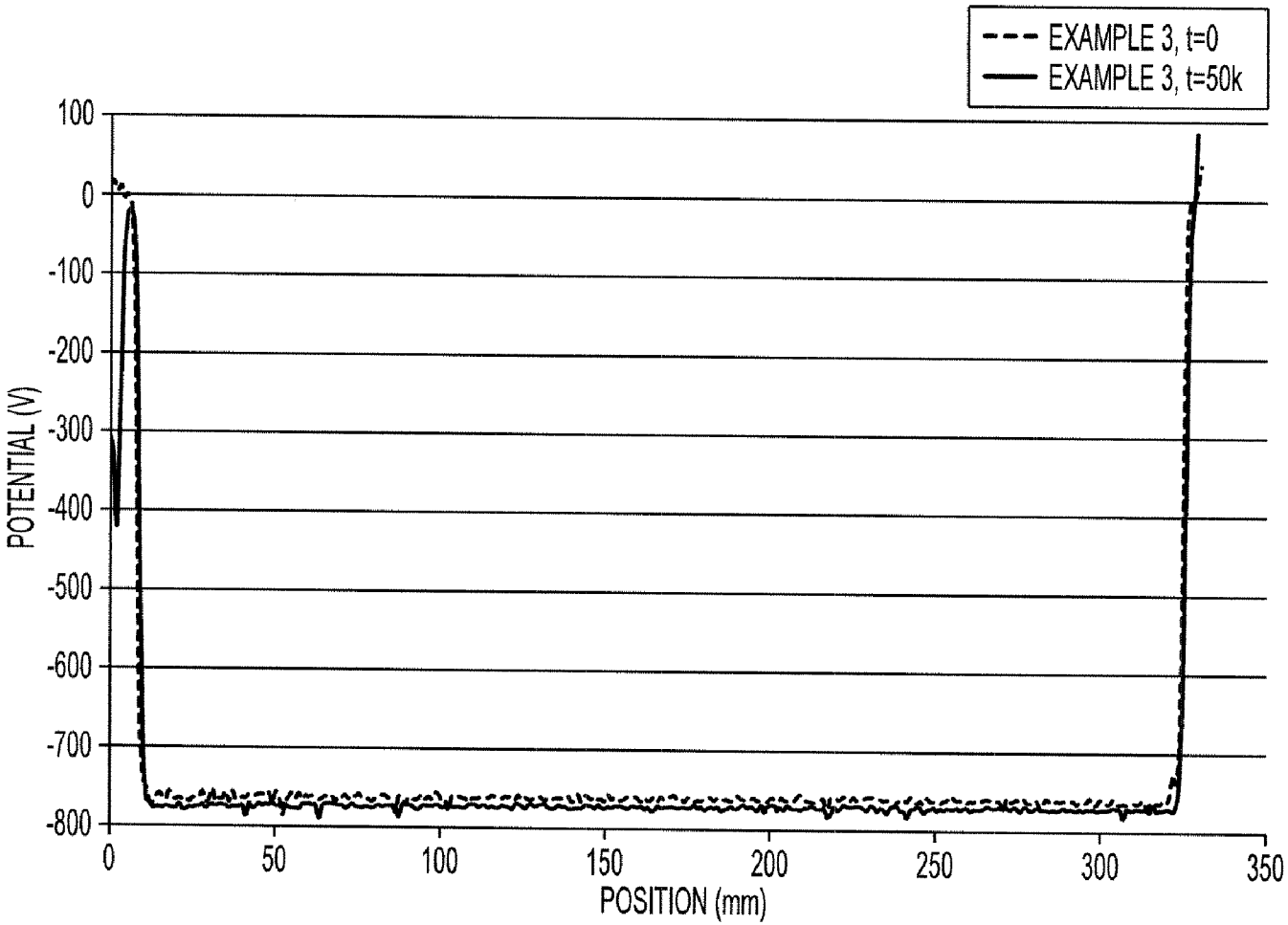
FIG. 7 is a graph showing the charge uniformity testing of a bias charge roller fabricated with an overcoat layer comprising an acrylonitrile-butadiene-styrene (ABS) terpolymer and undoped titanium dioxide particles.
Figure 8:
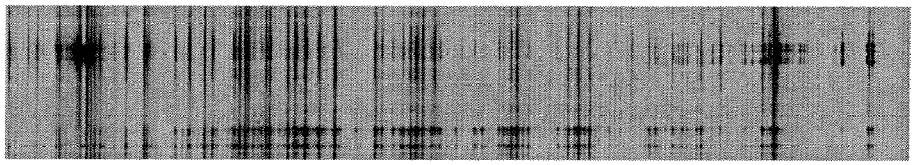
FIG. 8 illustrates a print image from a control imaging apparatus after 50,000 cycles wherein the bias charge roller does not have an overcoat layer.
Figure 9:
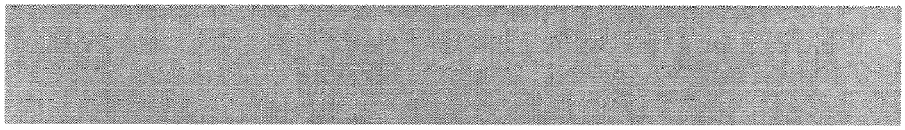
FIG. 9 illustrates a print image from an imaging apparatus fabricated with the overcoat layer of Example 1 after 50,000 cycles.
Figure 10:
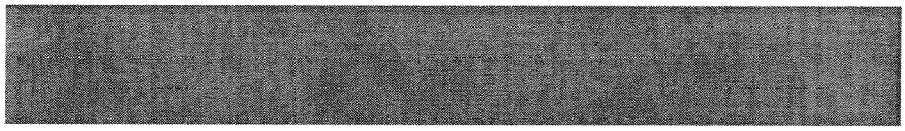
FIG. 10 illustrates a print image from an imaging apparatus fabricated with the overcoat layer of Example 2 after 50,000 cycles.
Figure 11:
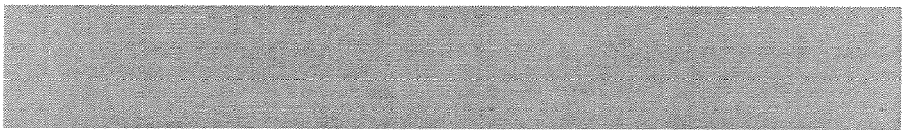
FIG. 11 illustrates a print image from an imaging apparatus fabricated with the overcoat layer of Example 3 after 50,000 cycles.

The charge uniformity tests for Comparative Example 1 are shown in FIG. 4, and the charge uniformity tests for Examples 1-3 are shown in FIGS. 5-7 respectively. For the x-axis of these graphs, 0 refers to one end of the roller and 328 refers to the other end of the roller. As can be seen in FIG. 4, the potential for Comparative Example 1 is a relatively straight line between the ends of the roller, both before and after the wear testing. Similarly, as seen in each of FIGS. 5-7, the potentials for Examples 1-3 are also relatively straight lines between the ends of the roller, both before and after the wear testing. This indicated that there was no electrical charge build-up in the overcoat layers and no deterioration of charge capacity, i.e. that the addition of the overcoat layer did not affect the relevant electrical properties of the bias charge roller.

Print Testing

FIGS. 8-11 show the results of the print testing for the bias charge rollers of Comparative Example 1, Example 1, Example 2, and Example 3, respectively. No print defects were observed in the bias charge rollers of Examples 1-3. On the other hand, the bias charge roller of Comparative Example 1 showed significant streaking. This indicated that the comparative bias charge roller sustained significant wear while the overcoat layer improved the wear resistance of the bias charge rollers of Examples 1-3.

Torque Cycling

Figure 12:
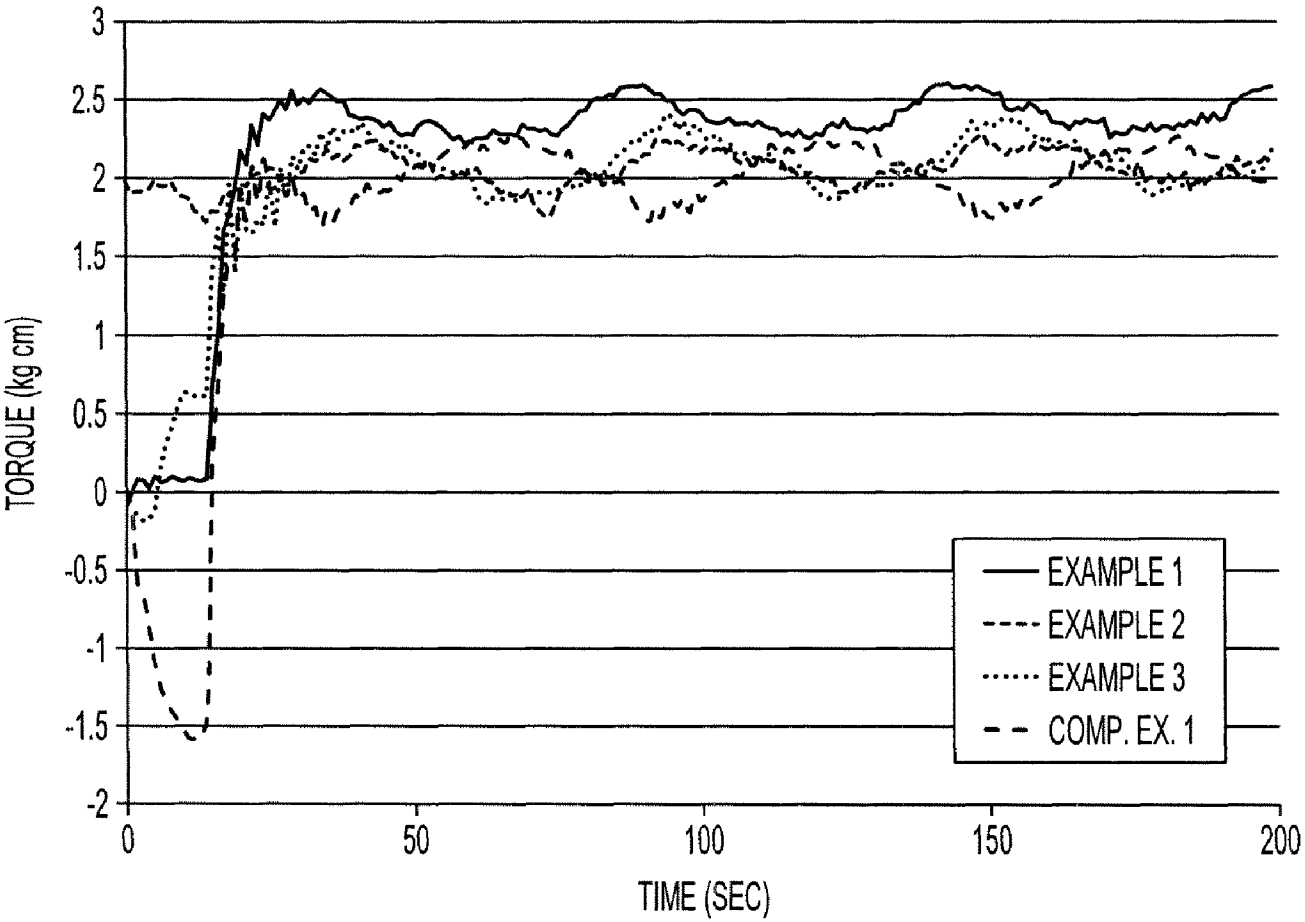
FIG. 12 is a graph showing starting torque cycling for three bias charge rollers fabricated according to the present disclosure compared to a conventional bias charge roller that lacks an overcoat layer.

Starting torque cycling was measured by running each of the bias charge rollers in a fixture equipped with a torque transducer. The results are shown in FIG. 12. This figure shows that applying an overcoat layer on the bias charge roller does not increase the torque in the apparatus compared to a bias charge roller without the overcoat layer. The negative torque reading at t=0 for Comparative Example 1 (the control) is probably a result of not zeroing out the instrument, i.e. the torque is not actually negative. Once the apparatus is operating continuously and the bias charge roller is running, there are no discernible differences in the torque between the non-overcoated rollers and the rollers with an overcoat layer.

Surface Resistivity

The surface resistivity of the metal oxide particles of Examples 1-3 was measured using a Hiresta UP Resistivity Meter with a supply voltage of 10V. The results are shown in Table 1.

TABLE 1

| Metal Oxide Particle | Surface Resistivity (Ω/sq) |
|---|---|
| Sb-doped $TiO_2$ | $1.53 \times 10^{7}$ |
| Fe-doped $TiO_2$ | $2.06 \times 10^{13}$ |
| $TiO_2$ | $4.54 \times 10^{10}$ |

The results showed that the surface resistivity of the overcoat layers fell within the range needed to produce acceptable charge uniformity and print quality.

While particular embodiments have been described, alternatives, modifications, variations, improvements, and substantial equivalents that are or may be presently unforeseen may arise to applicants or other skilled in the art. Accordingly, the appended claims as filed and as they are amended are intended to embrace all such alternatives, modifications, variations, improvements, and substantial equivalents.

What is claimed is:

1. A bias charge roller, comprising:
a core;
a conductive layer; and
an overcoat layer which includes metal oxide particles and an acrylonitrile-butadiene-styrene (ABS) terpolymer.

2. The bias charge roller of claim 1, wherein the metal oxide is titanium dioxide ($TiO_2$).

3. The bias charge roller of claim 1, wherein the metal oxide particles are doped with a doping agent.

4. The bias charge roller of claim 3, wherein the doping agent is iron or antimony.

5. The bias charge roller of claim 3, wherein the doping agent comprises from about 15 to about 50 wt % of the metal oxide particles.

6. The bias charge roller of claim 1, wherein the metal oxide particles comprise from about 40 to about 60 wt % of the overcoat layer.

7. The bias charge roller of claim 1, wherein the ABS terpolymer comprises from about 40 to about 60 wt % of the overcoat layer.

8. The bias charge roller of claim 1, wherein the overcoat layer has a thickness of from about 1 to about 50 μm.

9. The bias charge roller of claim 1, wherein the ABS terpolymer comprises from about 15 to about 35 wt % acrylonitrile, from about 5 to about 30 wt % butadiene, and from about 40 to about 60 wt % styrene.

10. The bias charge roller of claim 1, wherein the metal oxide particles have a surface resistivity of from about $10^5$ Ω/sq to about $10^{14}$ Ω/sq.

11. A cartridge for applying an electrical charge to an imaging member, comprising:
a bias charge roller to be situated in proximity to a surface of the associated imaging member; and
a power interface for supplying a voltage to the bias charge roller;
wherein the bias charge roller comprises a core, a conductive layer, and an overcoat layer; and
wherein the overcoat layer comprises metal oxide particles and an ABS terpolymer.

12. The apparatus of claim 11, wherein the metal oxide is titanium dioxide ($TiO_2$).

13. The apparatus of claim 11, wherein the metal oxide particles are doped with iron or antimony.

14. The apparatus of claim 11, wherein the metal oxide particles comprise from about 40 to about 60 wt % of the overcoat layer.

15. The apparatus of claim 11, wherein the ABS terpolymer comprises from about 40 to about 60 wt % of the overcoat layer.

16. An image forming apparatus for forming images on a recording medium comprising:

a) an electrophotographic imaging member having a charge-retentive surface to receive an electrostatic latent image thereon, wherein the electrophotographic imaging member comprises a substrate; an electrically conductive layer when the substrate is not electrically conductive; a charge generating layer; and a charge transport layer;

b) a development component to apply a developer material to the charge-retentive surface to develop the electrostatic latent image to form a developed image on the charge-retentive surface;

c) a transfer component for transferring the developed image from the charge-retentive surface to another member or a copy substrate;

d) a fusing member to fuse the developed image to the copy substrate; and e) a bias charge roller for applying a charge to the charge-retentive surface;

wherein the bias charge roller comprises a core, a conductive layer, and an overcoat layer which includes an ABS terpolymer and metal oxide particles.

17. The image forming apparatus of claim 16, wherein the metal oxide is titanium dioxide ($TiO_2$).

18. The image forming apparatus of claim 16, wherein the metal oxide particles are doped with iron or antimony.

19. The image forming apparatus of claim 16, wherein the metal oxide particles comprise from about 40 to about 60 wt % of the overcoat layer.

20. The image forming apparatus of claim 16, wherein the ABS terpolymer comprises from about 40 to about 60 wt % of the overcoat layer.

* * * * *